US009596744B2

(12) United States Patent
Leeser

(10) Patent No.: US 9,596,744 B2
(45) Date of Patent: Mar. 14, 2017

(54) RADIO FREQUENCY GENERATOR HAVING MULTIPLE MUTUALLY EXCLUSIVE OSCILLATORS FOR USE IN PLASMA PROCESSING

(71) Applicant: Lam Research Corporation, Fremont, CA (US)

(72) Inventor: Karl F. Leeser, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 144 days.

(21) Appl. No.: 14/675,700

(22) Filed: Mar. 31, 2015

(65) Prior Publication Data

US 2016/0295677 A1 Oct. 6, 2016

(51) Int. Cl.
*H01J 7/24* (2006.01)
*H05H 1/46* (2006.01)

(52) U.S. Cl.
CPC ..... *H05H 1/46* (2013.01); *H05H 2001/4645* (2013.01)

(58) Field of Classification Search
CPC ..... H01J 7/24; H05J 37/3299; H05B 31/26; H05H 1/46; H05H 2001/4645; H01L 21/306
USPC ..... 315/39, 111.01, 111.21, 111.71
See application file for complete search history.

(56) References Cited

U.S. PATENT DOCUMENTS

2013/0220549 A1* 8/2013 Wilson ..... H01J 37/32706 156/345.48

* cited by examiner

*Primary Examiner* — Jimmy Vu
(74) *Attorney, Agent, or Firm* — Martine Penilla Group, LLP

(57) ABSTRACT

A radio frequency (RF) power supply is provided. The RF power supply includes a first frequency oscillator for generating a first frequency signal and a second frequency oscillator for generating a second frequency signal. Also provided is an amplifier and a first switch connected to an output of the first frequency oscillator and a second switch connected to an output of the second frequency oscillator. An output of the first switch and the second switch are connected to an input of the amplifier. Also provided is a switch control coupled to the first switch and the second switch. The switch control is configured to enable a connection via the first and second switches from only one of the first frequency oscillator or the second frequency oscillator to the amplifier at one time. The amplifier is configured to power amplify both of the first and second frequency signals from the first and second frequency oscillators.

16 Claims, 8 Drawing Sheets

RADIO FREQUENCY GENERATOR HAVING MULTIPLE MUTUALLY EXCLUSIVE OSCILLATORS FOR USE IN PLASMA PROCESSING

BACKGROUND

1. Field of the Invention

The present embodiments relate to semiconductor wafer processing equipment tools, and more particularly, carrier rings used in chambers. The chambers being for processing and transport of wafers.

2. Description of the Related Art

Some semiconductor processing systems may employ plasma when depositing thin films on a substrate in a processing chamber. Generally, the substrate is arranged on a pedestal in the processing chamber. To create the thin film using chemical vapor deposition, one or more precursors are supplied by a showerhead to the processing chamber.

During processing, radio frequency (RF) power may be supplied to the showerhead or to an electrode to create plasma. For example, RF power may be supplied to the electrode embedded in a pedestal platen, which may be made of a non-conducting material such as ceramic. Another conducting portion of the pedestal may be connected to RF ground or another substantially different electrical potential.

When the electrode is excited by the RF power, RF fields are generated between the substrate and the showerhead to create plasma between the wafer and the showerhead. Plasma-enhanced chemical vapor deposition (PECVD) is a type of plasma deposition that is used to deposit thin films from a gas state (i.e., vapor) to a solid state on a substrate such as a wafer. PECVD systems convert a liquid precursor into a vapor precursor, which is delivered to a chamber. Depending on the processing operation, the RF power is provided to the processing chamber using more than one RF generator. The processing operation may also require processing using three different RF generators operating at three different frequencies. In such operations, combinations of two of the three frequencies are simultaneously delivered to the chamber (e.g., either pedestal or showerhead). Delivery of power in this configuration is referred to as multi-frequency RF excitation. Unfortunately, multi-frequency RF excitation will require implementation of multiple independent generators, of which have their own RF matching networks that then are coupled to a combiner network.

It is in this context that inventions arise.

SUMMARY

Embodiments of the disclosure provide radio frequency (RF) generator designs and implementations for combining multiple mutually exclusive frequency oscillators in a single generator and logic for selecting frequency oscillators for delivery of RF power to an electrode of a processing chamber. By implementing a multiple oscillator generator and utilizing selection logic, it is possible to implement tools for running a multi-frequency RF excitation process, without requiring standalone generators, for each require frequency and power.

In one embodiment, a radio frequency (RF) power supply is provided. The RF power supply includes a first frequency oscillator for generating a first frequency signal and a second frequency oscillator for generating a second frequency signal. Also provided is an amplifier and a first switch connected to an output of the first frequency oscillator and a second switch connected to an output of the second frequency oscillator. An output of the first switch and the second switch are connected to an input of the amplifier. Also provided is a switch control coupled to the first switch and the second switch. The switch control is configured to enable a connection via the first and second switches from only one of the first frequency oscillator or the second frequency oscillator to the amplifier at one time. The amplifier is configured to power amplify both of the first and second frequency signals from the first and second frequency oscillators.

RF generators can be simplified down to a signal source to generate a high frequency signal coupled to a power amplifier. The power amplifier can be one of many power amplifier classes, typically C, D, or E with different merits and demerits of each design class. The signal source is typically a fixed oscillator in most applications, especially those that employ an automatic RF impedance matching network, or a variable oscillator in frequency "tuning" (RF impedance matching) applications. In the embodiments described herein, it should be understood that an oscillator may also be referred to as a waveform generator or a variable oscillator. If frequency tuning is performed, the frequency oscillator can be a variable oscillator or a waveform generator. When frequency tuning is performed, one embodiment may also include dynamically tuning the match for each selected frequency.

In one embodiment, for deposition operations that require two simultaneous frequencies, e.g., PECVD applications, the multi-frequency generator disclosed herein will provide cost efficiencies by not having to provide a separate generator that must be independently matched and then "combined" in a power level sense for each of the two simultaneous frequencies.

In one embodiment, a single generator with two independent frequency generators, e.g., oscillators, is provided. In one example, a first oscillator is configured to operate a 2 MHz frequency and a second oscillator is configured to operate a 27 MHz frequency. In another embodiment, the first oscillator is configured to operate a 13.56 MHz frequency and a second oscillator is configured to operate a 27 MHz frequency. In some embodiments, a common power amplifier class can be used. Generally, the closer the frequencies are, the more efficient it is to utilize a common power amplifier. If frequencies, such as 400 kHz and 13.56 MHz are used in a single generator, the common power amplifier may require one or more additional amplification stages or multiple power amplifiers for generating a single combined amplified signal. In other embodiments, the amplifier is a channelized amplifier having a bandwidth to amplify a wider range of frequencies, e.g., sometimes referred to as a broadband amplifier. A channelized amplifier can thus amplify each selected frequency. The frequency range of the amplifier may be set or configured to service frequencies extending from around 400 kHz to about 60 MHz, or ranges between 13.56 MHz and 27 MHz, depending on the implementation.

In one implementation, a plasma chamber used to deposit material layers is provided. The chamber can be configured to deposit a stack of layers. In such configuration, each layer of the stack can be deposited using two frequencies delivered to an electrode of the chamber. This implementation may use a first RF power supply that includes two separate frequency oscillators, and a second RF power supply that includes a single frequency oscillator. The first RF power supply may be configured to supply 400 KHz and the second RF power supply may be configured to supply 13.56 MHz and 27 MHz. In a first mode setting, one layer of the stack can be deposited using 400 KHz and 13.56 MHz. In a second mode setting, a next layer of the stack can be deposited using 400 KHz and 27 MHz. If the stack includes more layers, the modes can continue in an alternating fashion. It should be noted that this implementation only uses two RF power supplies, even though three separate frequencies are used to deposit the stack of layers.

In another embodiment, a class of RF excitation that is generated is an electrical asymmetry effect (EAE) excitation, wherein two frequencies are used. One of the frequencies is a higher frequency that is an even multiple of a lower frequency, and both frequencies are simultaneously employed with an intentional phase shift between them. Having both frequency generators in the same single generator provides for an efficient manner of communicating the phase shift signal between the two frequency generators.

Broadly speaking, the embodiments described herein provide various configurations for a single generator with multiple frequency generators (e.g., oscillators). An example is for a single generator to include two oscillators that are recipe selectable and mutually exclusive. Since they are mutually exclusive, the voltage scaling electronic circuitry may be commonly shared and need not be independent. In another example, a single generator includes two oscillators, each with their own independent voltage scaling electronic circuitry that are simultaneous with their outputs summed together. In still another example, a single generator includes two oscillators, each with their own independent voltage scaling electronic circuitry that are simultaneous with their outputs summed together and with a recipe selectable, nonzero phase shift between them.

In another embodiment, a system for processing a semiconductor wafer is provided. The system includes a processing chamber. The processing chamber includes a pedestal for supporting the semiconductor wafer when present, an electrode and a showerhead for delivering process gases into the chamber when processing a deposition layer over a surface of the semiconductor wafer. The system further includes a first RF power supply having a single frequency oscillator for generating a single frequency signal. The first RF power supply includes a first amplifier having an output that is connected to the electrode of the processing chamber via a first transmission line and wherein the first amplifier is for amplifying the single frequency signal of the single frequency oscillator. The system also includes a second RF power supply having a first frequency oscillator for generating a first frequency signal and a second frequency oscillator for generating a second frequency signal. The second RF power supply includes a second amplifier, and the second RF power supply includes a first switch connected to an output of the first frequency oscillator and a second switch connected to an output of the second frequency oscillator. An output of the first switch and the second switch connect to an input of the second amplifier and an output of the second amplifier has an output that is connected to the electrode of the processing chamber via a second transmission line. The second RF power supply includes a switch control coupled to the first switch and the second switch. The switch control is configured to enable a connection via the first and second switches from only one of the first frequency oscillator or the second frequency oscillator to the second amplifier at one time. The second amplifier is for amplifying both of the first and second frequency signals from the first and second frequency oscillators. The system also includes a controller for setting a recipe that defines a sequence of multi-frequency applications from the first and second RF power supplies to the electrode of the processing chamber. The recipe defines a first mode that applies the single frequency signal from the first RF power supply together with the first frequency signal from the second RF power supply, and a second mode that applies the single frequency signal from the first RF power supply together with the second frequency signal from the second frequency signal. The controller enables the first and second mode to deposit a first layer material and the second mode to deposit a second layer material over the first layer material. The recipe defines a number of times the first and second modes repeat. Wherein only the first and second RF power supplies are included for supplying power to the system to enable the three frequency signals that include the first frequency signal, the second frequency signal and the single frequency signal.

In one configuration, the system also includes a frequency control coupled to each of the first frequency oscillators and the second frequency oscillator of the second RF power supply. The frequency control is configured to tune a frequency setting of the first and second frequency oscillators to compensate for signal match when an output of the second amplifier is communicated to the second transmission line.

In one configuration of the system, the first frequency signal is about 13.56 MHz and the second frequency signal is about 27 MHz and the single frequency signal is about 400 KHz, wherein, the first mode applies 13.56 MHz and 400 KHz together to the electrode, and the second mode applies 27 MHz and 400 KHz together to the electrode.

In one embodiment of the system, the RF power supply that provides the first and second frequency signals is integrated as a single generator unit.

DESCRIPTION

Figure 1:
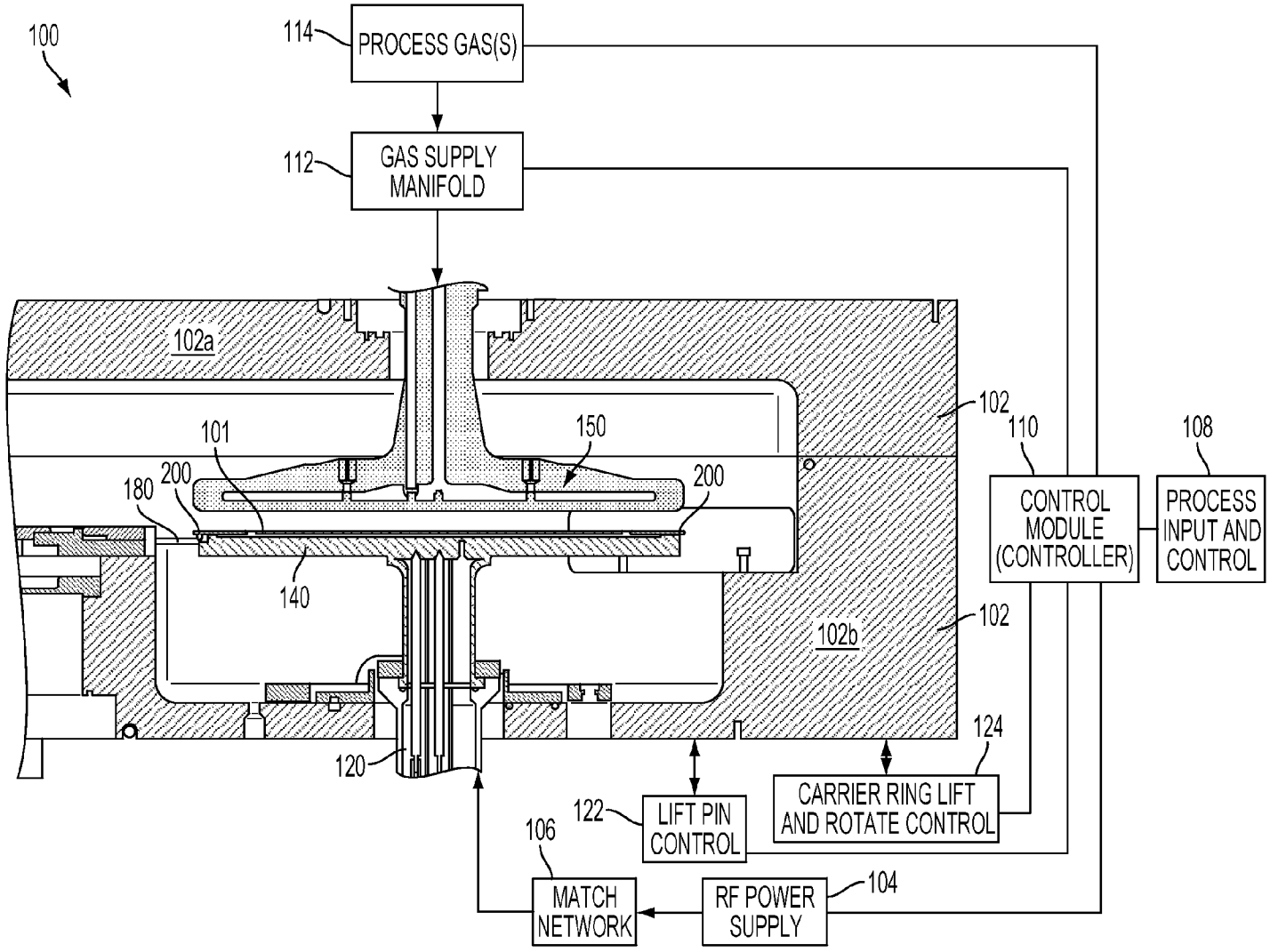
FIG. 1 illustrates a substrate processing system, which is used to process a wafer, e.g., to form films thereon.

Embodiments of the disclosure provide a radio frequency (RF) power supply is configured to delivery more than one RF frequency. The RF power supply includes a first frequency oscillator for generating a first frequency signal and a second frequency oscillator for generating a second frequency signal. Also provided is an amplifier and a first switch connected to an output of the first frequency oscillator and a second switch connected to an output of the second frequency oscillator. An output of the first switch and the second switch are connected to an input of the amplifier. Also provided is a switch control coupled to the first switch and the second switch. The switch control is configured to enable a connection via the first and second switches from only one of the first frequency oscillator or the second frequency oscillator to the amplifier at one time. The amplifier is configured to power amplify both of the first and second frequency signals from the first and second frequency oscillators. In embodiment of the systems, the RF power supply that provides the first and second frequency signals is integrated as a single generator unit.

RF generators have historically been designed with nominal single frequency use in mind and almost all industrial applications e.g. iron ore melting with inductive heating leverage are single frequency. In the embodiments described herein, multiple frequency RF excitation is provided using a single generator. Providing multiple frequencies simultaneously to an electrode or electrodes of a plasma processing chamber is becoming increasingly common. However, current configurations rely on separate generators for each frequency. Embodiments described herein provide for a simplification of the overall system that includes inserting multiple frequency oscillators in a single generator. In some embodiments, the single generator may include phase shifting or locking capability on the small signal (amplifier input) side rather than the power level (amplifier output) side.

It should be understood that the generators and frequency configurations of the generators disclosed herein are usable for deposition of films on semiconductor wafers. Deposition of films is preferably implemented in a plasma enhanced chemical vapor deposition (PECVD) system. The PECVD system may take many different forms. A PECVD system includes one or more chambers or "reactors" (sometimes including multiple stations) that house one or more wafers and are suitable for wafer processing. Each chamber may house one or more wafers for processing. The one or more chambers maintain the wafer in a defined position or positions (with or without motion within that position, e.g. rotation, vibration, or other agitation). A wafer undergoing deposition may be transferred from one station to another within a reactor chamber during the process. Of course, the film deposition may occur entirely at a single station or any fraction of the film may be deposited at any number of stations. It should be appreciated that the present embodiments can be implemented in numerous ways, such as a process, an apparatus, a system, a device, or a method. Several embodiments are described below.

FIG. 1 illustrates a substrate processing system 100, which is used to process a wafer 101. The system includes a chamber 102 having a lower chamber portion 102*b* and an upper chamber portion 102*a*. A center column is configured to support a pedestal 140, which in one embodiment is a powered electrode. The pedestal 140 is electrically coupled to power supply 104 via a match network 106. The power supply 104 may be defined from a single generator having two or more selectable and mutually exclusive oscillators. The power supply 104 is controlled by a control module 110, e.g., a controller. The control module 110 is configured to operate the substrate processing system 100 by executing process input and control 108. The process input and control 108 may include process recipes, such as power levels, timing parameters, process gasses, mechanical movement of the wafer 101, etc., such as to deposit or form films over the wafer 101.

The center column is also shown to include lift pins 120, which are controlled by lift pin control 122. The lift pins 120 are used to raise the wafer 101 from the pedestal 140 to allow an end-effector to pick the wafer and to lower the wafer 101 after being placed by the end end-effector. The substrate processing system 100 further includes a gas supply manifold 112 that is connected to process gases 114, e.g., gas chemistry supplies from a facility. Depending on the processing being performed, the control module 110 controls the delivery of process gases 114 via the gas supply manifold 112. The chosen gases are then flown into the shower head 150 and distributed in a space volume defined between the showerhead 150 face which faces that wafer 101 and the wafer 101 resting over the pedestal 140.

Further, the gases may be premixed or not. Appropriate valving and mass flow control mechanisms may be employed to ensure that the correct gases are delivered during the deposition and plasma treatment phases of the process. Process gases exit chamber via an outlet. A vacuum pump (e.g., a one or two stage mechanical dry pump and/or a turbomolecular pump) draws process gases out and maintains a suitably low pressure within the reactor by a close loop controlled flow restriction device, such as a throttle valve or a pendulum valve.

Also shown is a carrier ring 200 that encircles an outer region of the pedestal 140. The carrier ring 200 is configured to sit over a carrier ring support region that is a step down from a wafer support region in the center of the pedestal 140. The carrier ring includes an outer edge side of its disk structure, e.g., outer radius, and a wafer edge side of its disk structure, e.g., inner radius, that is closest to where the wafer 101 sits. The wafer edge side of the carrier ring includes a plurality of contact support structures which are configured to lift the wafer 101 when the carrier ring 200 is lifted by forks 180. The carrier ring 200 is therefore lifted along with the wafer 101 and can be rotated to another station, e.g., in a multi-station system. In other embodiments, the chamber is a single station chamber. In such construction, the focus ring or edge ring is used, instead of a carrier ring. In either configuration, RF power is supplied to an electrode of the chamber so that a plasma can be generated for deposition. In other configurations, the RF power may be supplied to a plasma used for an etching operation. More detail regarding the multi-frequency generator used to supply RF power to a chamber is provided below with reference to FIGS. 2A-5.

Figure 2A:
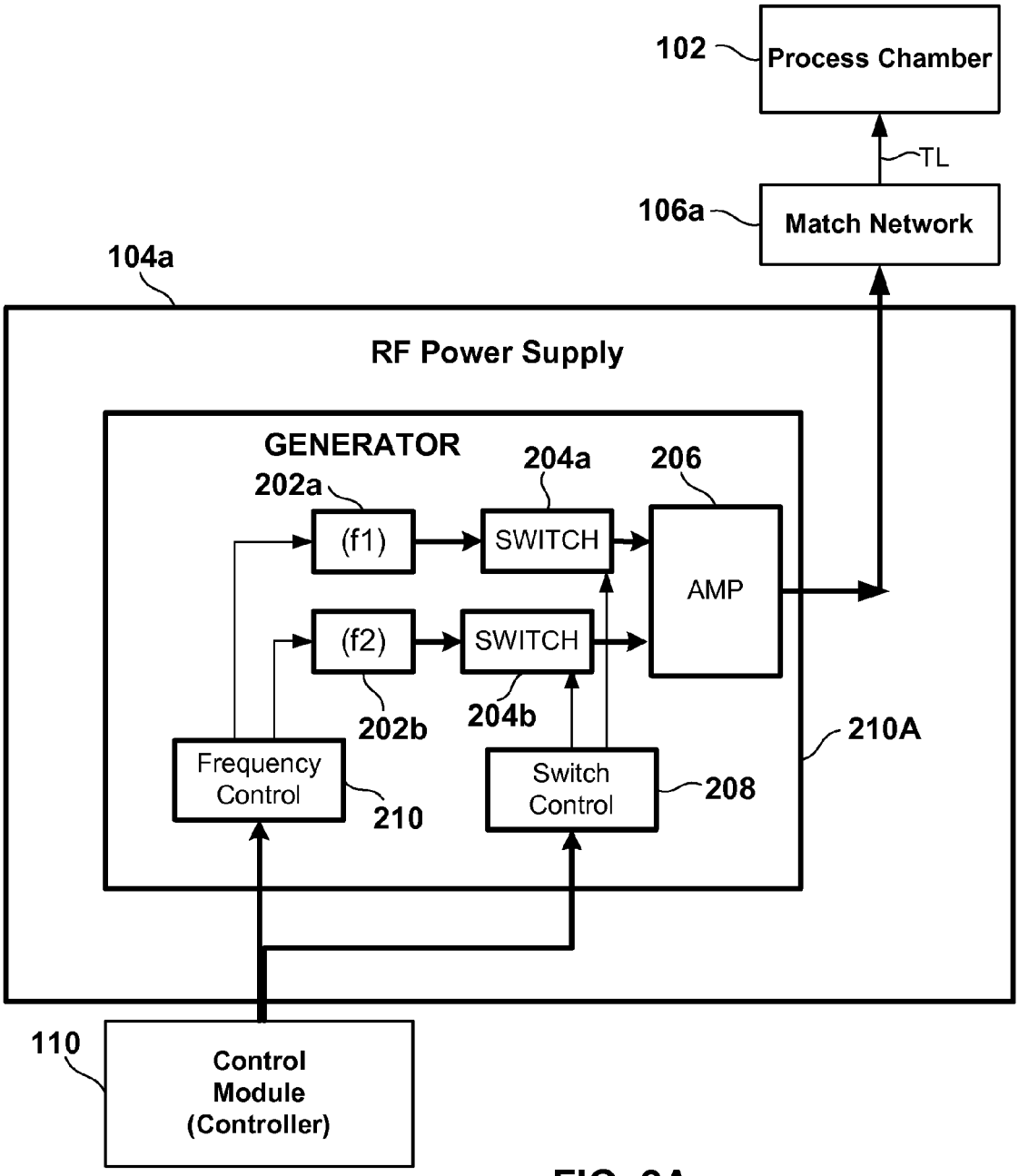
FIG. 2A illustrates an example RF power supply having two separate independent frequency oscillators, which are selectable and share common amplifier logic, in accordance with one embodiment of the present invention.

FIG. 2A illustrates a system that includes an RF power supply 104*a* having a generator 210A for providing radio frequency power to a process chamber 102. An output of the generator 210A is coupled to a match network 106*a* that connects to a transmission line (TL). The TL connects to an electrode of the process chamber 102. In this embodiment, the RF power supply 104*a* is receiving control information from the control module 110, which is a controller for a system that includes the process chamber 102, the match network 106*a* and the RF power supply 104*a*. The control module 110 is configured to set the operating state and modes of the RF power supply 104*a*.

As mentioned above, one embodiment of the RF power supply 104*a* is that multiple independent frequency oscillators are integrated as part of the single generator of the RF power supply 104*a*. In this example, frequency oscillator (f1) 202*a* and frequency oscillator (f2) 202*b* are integrated with the generator 210A. Also included is a switch 204*a* and a switch 204*b*, which are located at the output of the frequency oscillators 202*a* and 202*b*, respectively. Each of the switches 204 are coupled to an amplifier 206 that is shared by each of the frequency oscillators 202*a* and 202*b*. In one embodiment, the amplifier is a channelized power amplifier having circuitry to amplify across a bandwidth of frequencies. The power amplifier may be a broadband amplifier. By way of example, the frequency range of the amplifier may be set or configured to service frequencies extending from around 400 kHz to about 60 MHz, or ranges between 13.56 MHz and 27 MHz, or between 400 kHz and 13.56 MHz, or between 27 MHz and 60 MHz, etc. In general, the amplifier should be selected or configured based on the range of frequency oscillators integrated into a single generator.

The generator 210A further includes a switch control 208 that is configured to cause the switching to open or close switches of the switches 202*a* and 202*b*. In one embodiment, the switches may be semiconductor switches that receive signals that cause the switches to turn on or off, open or close, or activate or deactivate. The semiconductor switches may, in some configurations, be defined from one or more transistors and other logic, which may be part of an integrated circuit chip.

In general, if the switch is allowed to conduct the frequency from one of the frequency oscillators 202, the switch is considered to be closed. If the frequency is not allowed to conduct through the switch, the switch will be considered open. As shown, the switch control 208 is coupled to each of the switches 204*a* and 204*b*. Depending on the frequency that is to be amplified by amplifier 206, the switch control 208 will set the appropriate logic state to cause the switches to pass the selected frequency from the frequency oscillators 202 so that amplification can be performed by the amplifier 206. In one embodiment, the amplifier can have circuitry for handling the amplification.

Typical circuitry implemented by amplifier 26 may include a pre-amplifier followed by an amplifier. Generally, amplifier 206 should be understood to be configured for amplifying frequencies suitable for the specific implementation. In one implementation, the frequency oscillators 202*a* and 202*b* may be a 13.56 MHz frequency oscillator and a 27 MHz oscillator, respectively. For an implementation that has or utilizes these frequencies, a suitable amplifier should be tunable for amplifying each of the two provided frequencies received from the frequency oscillators 202*a* and 202*b*. The output of the amplifier 206 is coupled to a match network 106*a* that is configured to tune the signals output by the amplifier 2064 optimum transmission of the RF power over the transmission line (TL) for delivery to the electrode of the process chamber 102.

In one embodiment, a frequency control 210 is also integrated with the generator 210A. The frequency control 210 is coupled to each of the frequency oscillators 202*a* and 202*b*, such that individual tuning of each of the frequency oscillators can be made to further optimize the match. For example, if the frequency of the frequency oscillator 202*a* is 13.56 MHz, the frequency control may assist in tuning the frequency to a range of +/−1%-10%. In a similar manner, if the frequency oscillator 202*b* is 27 MHz, the frequency control may assist in tuning the frequency to a range of +/−1%-10%. Because the amplifier 206 is shared between the two frequency oscillators, the amplifier may not be properly matched by the match network 106*a* or may be further optimized for matching by simply adjusting the frequency in a tunable manner up or down slightly. This slight tuning can improve the match when each of the frequencies are generated by the independent frequency oscillators 202. In alternative embodiments, the frequency control 210 may be omitted, if the network match 106*a* is sufficiently tuned to handle the match for each of the separate frequencies provided by the different frequency oscillators 202.

Figure 2B:
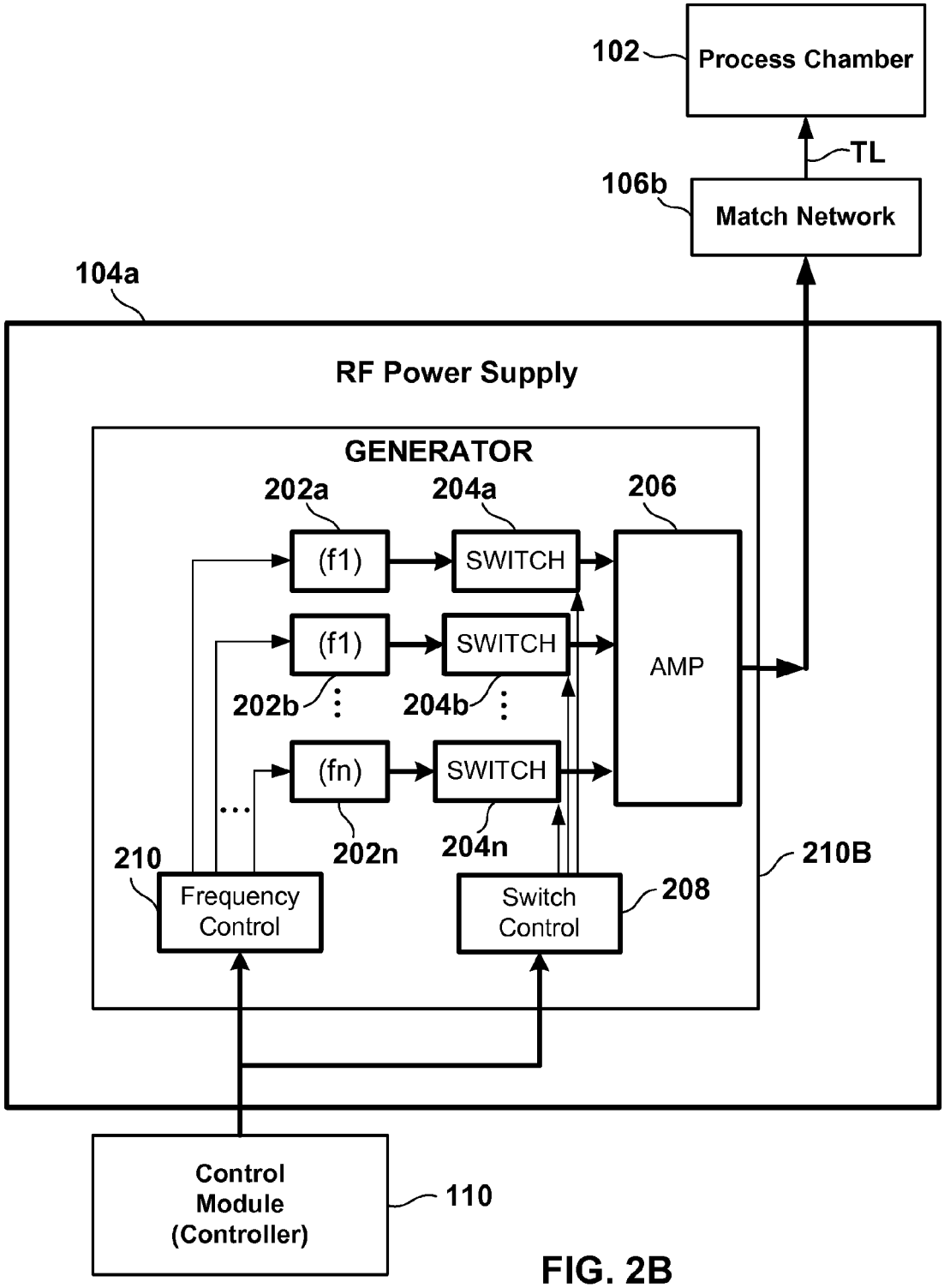
FIG. 2B illustrates an example where multiple frequency oscillators are integrated into a single RF generator and switching logic is provided to shared amplifier logic, in accordance with one embodiment of the present invention.

FIG. 2B illustrates an example of a generator 210B that includes a plurality of frequency oscillators 202*a*-202*n*. Similarly, a plurality of switches 204*a*-204*n* is provided at outputs of the individual frequency oscillators 202. Each of the switches is controllable by switch control 208. In this example, the optional frequency control to 10 may also be provided to enable frequency tuning of each of the frequency oscillators 202 depending on the match requirements. A single amplifier 206 is also provided as shared circuitry for each of the frequency oscillators 202.

By sharing the amplifying circuitry 206 and other logic circuitry within the generator 210B, the generator design is simplified yet it enables operation as if the generator were different frequency generators. In one embodiment, the frequencies that may be operable by the generator 210B for each of the frequency oscillators 202*a*-202*n* may include, by way of example, 400 kHz, 2 MHz, 13.56 MHz, 27 MHz, 60 MHz, and other commonly utilized frequencies. In some embodiments, depending on the separation between the frequencies of the frequency oscillators 202, additional tuning circuitry may be contained within the amplifier 206 to enable sharing of at least part of the amplification circuitry 206.

If the frequencies of the frequency oscillators are close enough to each other in frequency band, the amplifier 206 will operate without modification so that the same circuitry provides amplification to each of the frequency oscillators. In general, amplification circuitry and other immigration circuitry within the generator 210B is shared circuitry among the separate and independent frequency oscillators 202*a*-202*n*. In this configuration, the control module 210 is also shown communicating with the RF power supply 104*a* and also communicating with the switch control 208 and the frequency control 210. The output of the amplifier 206 is coupled to match network 106*b* which then communicates with process chamber 102 via a transmission line (TL).

Figure 3A:
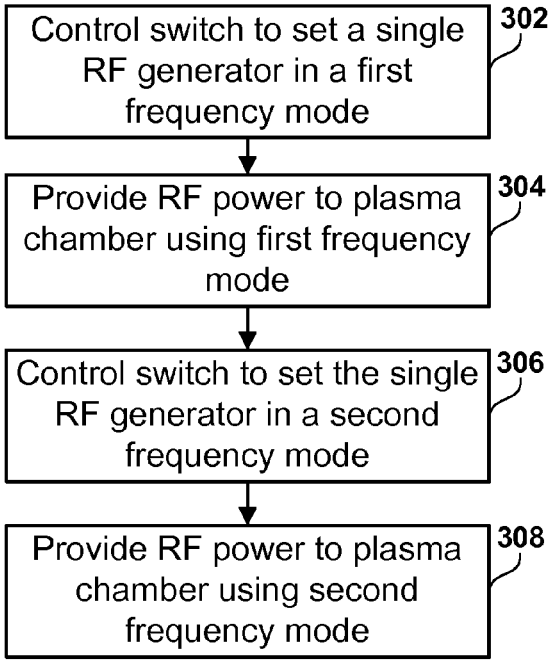
FIGS. 3A-3C illustrate example flow diagrams associated with configuring RF generators to operate with multiple frequencies and operations for communicating RF power to plasma process chambers used for deposition, in accordance with one embodiment of the present invention.

FIG. 3A illustrates one example flow for configuring a plasma chamber utilized for depositing films, wherein an RF generator having multiple frequency modes is utilized. In operation 302, a switch control is set so that the RF generator is placed into a first frequency mode. The first frequency mode, for example is the selection of one of the frequency oscillators of a single RF generator having multiple frequency oscillators that operate at different frequencies. In operation 304, RF power is provided to a plasma chamber using the first frequency mode. In this operation, the RF power is provided so that a deposition operation can be performed utilizing the RF power.

In one implementation, in addition to the RF power provided by the RF generator in accordance with the first frequency mode, the plasma chamber can also be provided with another frequency from a second generator. In such a configuration, the deposition would be performed by the plasma chamber utilizing two simultaneous frequencies (one delivered by a generator having a single frequency and one delivered by a generator having multiple frequencies where one is selected). In operation 306, a control switch is set so that the single RF generator is placed in a second frequency mode.

The second frequency mode is one where the single RF generator will output frequency power in accordance with a second frequency oscillator that is selected. As noted above, the second frequency output from the second frequency oscillator of the single RF generator can be delivered to an electrode of the plasma chamber in operation 308 along with another frequency from another RF generator. In this general example, the single RF generator may be configured to provide 2 separate frequencies using two separate frequency oscillators, such as one oscillator operating at 13.56 MHz and another oscillator operating a 27 MHz. The second generator having a single RF frequency oscillator may be operated at 400 kHz.

Figure 3B:
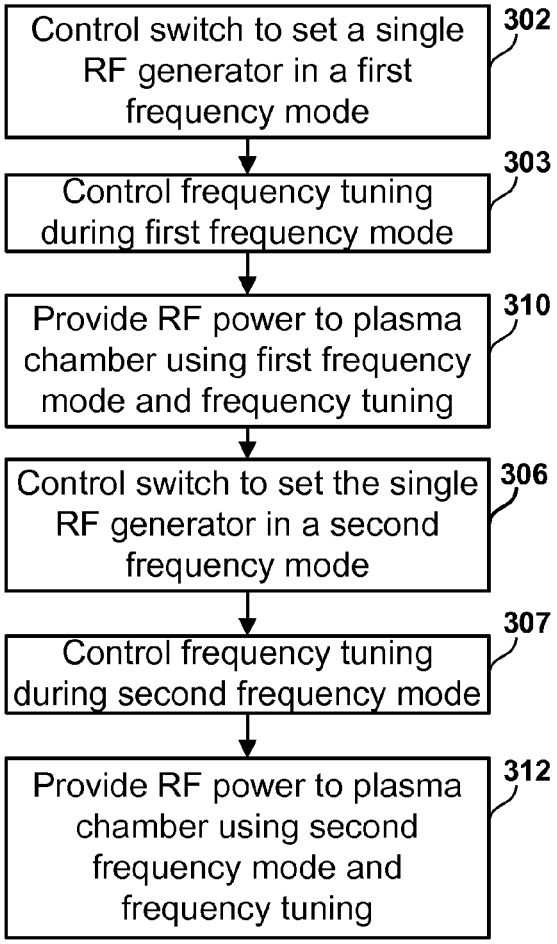

FIG. 3B illustrates an example process where tuning of the frequency oscillators in the first frequency mode and the second frequency mode is performed. As noted above, frequency tuning is an optional feature that will allow additional match compensation to the RF power due to the shared amplifier construction in the single RF generator (i.e. having multiple RF frequency oscillators). After operation 302, operation 303 enables the control of the frequency tuning during application of the first frequency mode.

The frequency tuning may be performed just before the frequency is applied or during the application of the frequency. In operation 310, the RF power is provided to the plasma chamber using the first frequency mode and the frequency tuning. In operation 306, control is provided to switch the single RF generator to a second frequency mode (selecting a different RF frequency oscillator within the single generator). In operation 307, frequency tuning can be performed upon the second frequency mode. In this embodiment, frequency tuning would be provided to the second RF oscillator, such as to adjust the frequency slightly to compensate for match or less than perfectly optimal match through the amplifier 206 that is shared by the single RF generator. In operation 310, the RF power that is provided to the plasma chamber uses the second frequency mode and frequency tuning.

Figure 3C:
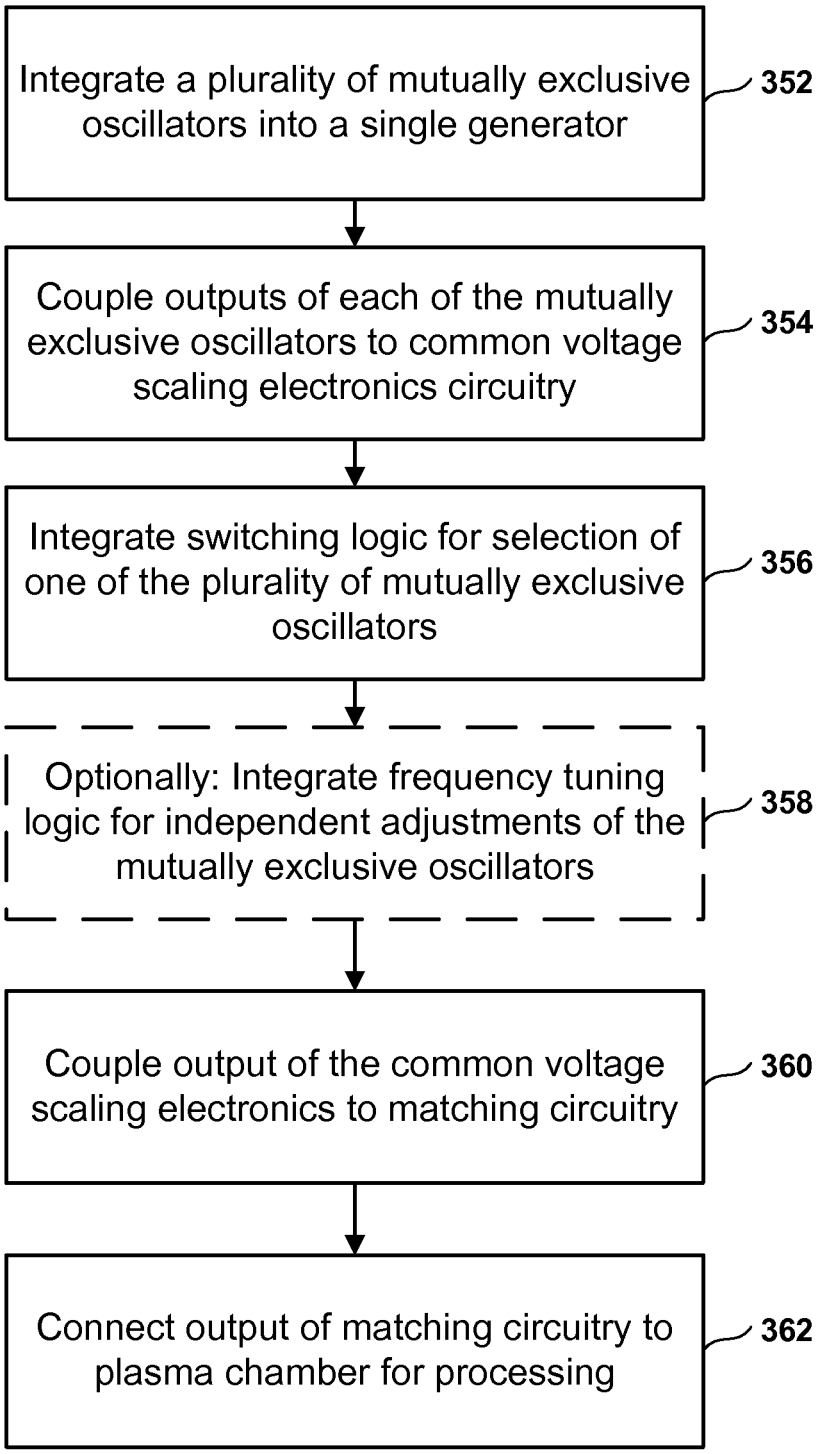

FIG. 3C illustrates an example embodiment where a plurality of mutually exclusive oscillators is integrated into a single generator, in operation 352. In this example, the plurality of mutually exclusive oscillators is configured to independently operate when selected, for example using a switch, circuit, selector module, or other electronics suitable for performing the mutually exclusive selection. In operation 354, an output of each of the mutually exclusive oscillators is coupled to a common voltage scaling electronics circuitry. The common voltage scaling electronic circuitry, in one embodiment, may include an amplifier. The amplifier may also include a pre-amplifier.

The amplifier circuitry may also include other tuning elements and coupling elements to allow connections to the outputs of the switches in the generator. Furthermore, the generator may include other logic circuitry for enabling the integration of the multiple switches and for the logical connections and electric connections to the amplifier disposed therein. In operation 356, switching logic is integrated for selection of one of the plurality of mutually exclusive oscillators. The switching logic can include switches that are solid-state switches, physical switches, wired switches, electronic switches, and other suitable constructions. As in the example of FIG. 2B, multiple switches can be coupled such that their inputs connect to the outputs of the frequency oscillators and the outputs of the switches coupled to the amplifier 206. In operation 358, frequency tuning logic may be optionally integrated into the RF generator to allow for independent adjustment of each of the mutually exclusive oscillators.

As noted above, the frequency tuning may allow for slight tuning of the frequency around the main frequency band of the frequency oscillator. Frequency tuning that is less than +/−10% is usually sufficient to provide additional match for the power delivered by the single RF generator. In operation 360, the output of the common voltage scaling electronics is coupled to match circuitry. The match circuitry includes capacitors and inductors that are tuned to provide impedance matching across a transmission line, which reduces power reflections and optimize the power transfer. The match circuitry is then connected in operation 362 to a transmission line so it can connect to the plasma chamber.

The connection of the transmission line will be to an electrode of the plasma chamber. As noted above, the electrode may be associated with the pedestal of the chamber where the semiconductor wafer will be placed for processing. In another embodiment, the RF power may be delivered to the showerhead. The delivery point of the RF power is dependent upon the chamber configuration and the embodiments of the multiple frequency generator having mutually exclusive oscillators shall be considered equally capable of providing RF power to any electrode within the processing chamber.

Figure 4:
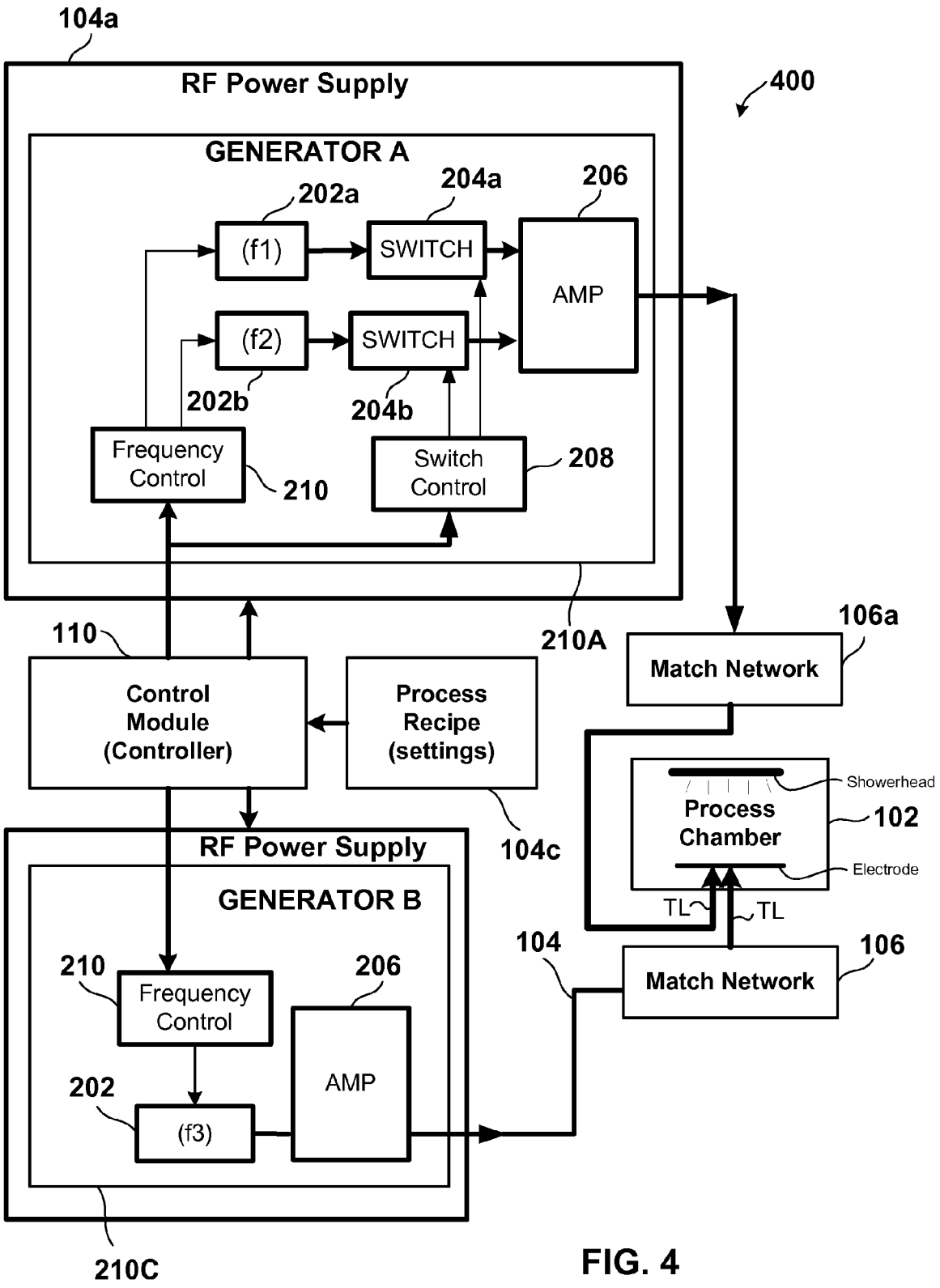
FIG. 4 illustrates one configuration where to RF power supplies are used to communicate three separate frequencies to a process chamber, wherein one of the RF power supplies is capable of providing two separate frequencies and utilizing one of the two separate frequencies for simultaneous application with the frequency from the single frequency chamber, in accordance with one embodiment of the present invention.

FIG. 4 illustrates an example where a single frequency RF power supply 104*c* having a generator 210C is utilized along with a multiple frequency power supply 104*a*, and a control module 110 is utilized to control when each of the generators provide frequency power to an electrode of the process chamber 102. In this embodiment, it is envisioned that the RF power supply 104*a* can provide a first RF frequency power (f1) at the same time that the RF power supply 104*c* provides an RF frequency power (f3). In this example, frequency (f1) may be 13.56 MHz and frequency (f3) may be 400 kHz.

During the simultaneous application of frequencies f1 and f3 to the electrode of the process chamber 102, a first layer of a multilayer deposition process may be formed. For example, the first layer might be silicon nitride (SiN). This first layer deposition may be considered a first mode of depositing a material using to frequency generators. Once this first layer of the multilayer deposition processes forms, the control module 110 will switch the RF power supply 104*a* and output frequency (f2) at the same time that the RF power supply 104*c* provides an RF frequency power (f3). In this example, the frequency (f2) may be 27 MHz and the frequency (f3) may remain at 400 kHz. The second layer might be considered silicon oxide (SiO2). There are many types of silk and oxides and one example may be Tetraethyl orthosilicate (TEOS).

The forming of the second layer deposition may be considered a second mode of depositing a material using two frequency generators. These deposition operations are in one embodiment plasma enhanced chemical vapor deposition (PECVD) operations. PECVD processes used to deposit thin films from a gas state (vapor) to a solid state on a substrate. Chemical reactions are involved in the process, which occur after creation of a plasma of the reacting gases using the delivered RF power. In this case, the delivered RF power is a combination of 2 RF power generators delivering to different frequencies at the same time. Depending on the recipe or desired implementation, after the second mode of depositing materials complete, the first mode may be repeated and then the second mode repeated again, and the cycle repeats one or more times depending on the recipe. Although example materials for the different deposited layers of a multi-stack layer deposition process is described herein, or other materials may also be deposited using the multi-frequency delivery method that delivers more than one frequency to an electrode simultaneously.

Figure 5:
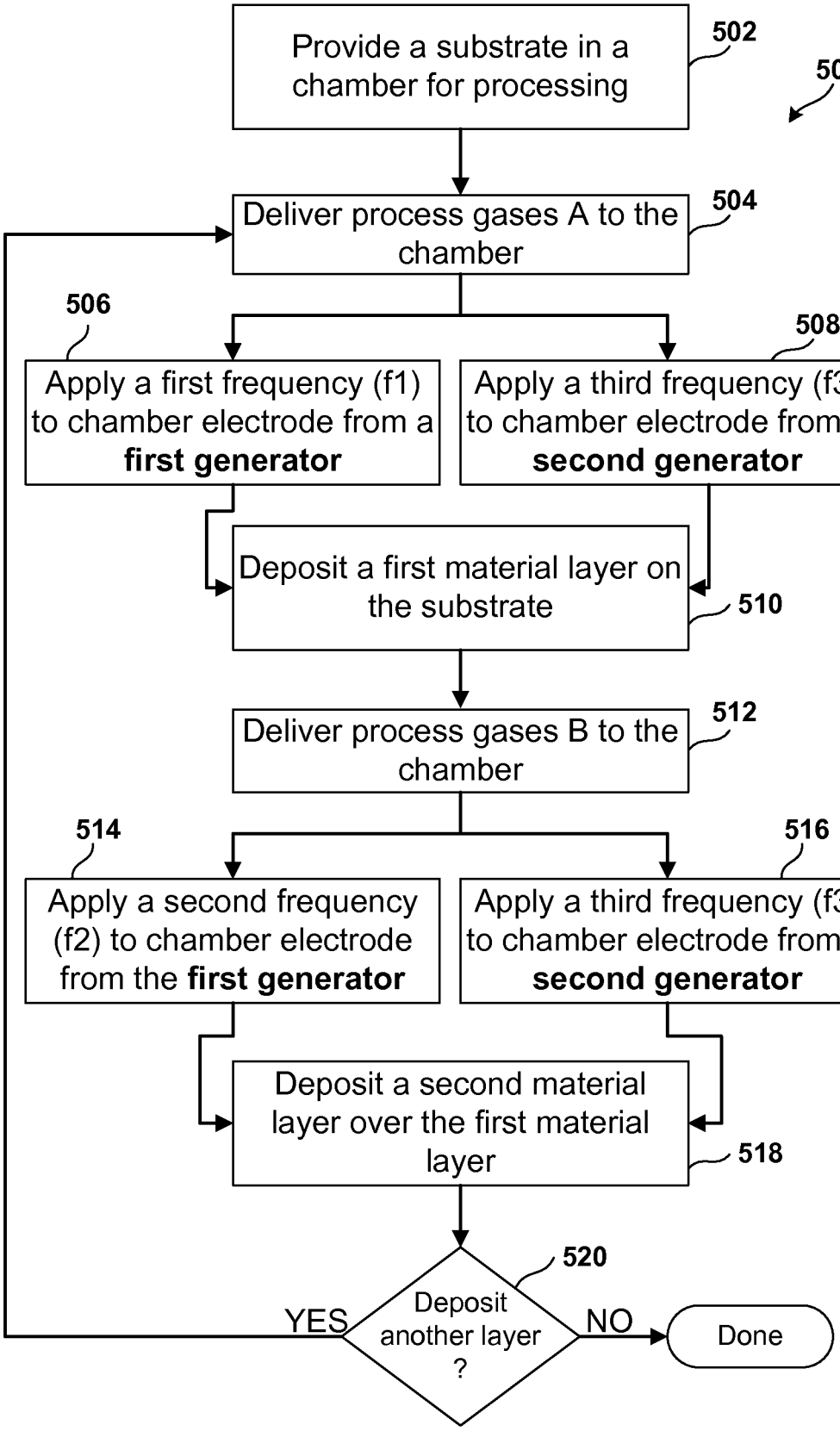
FIG. 5 illustrates an example process flow for depositing multiple layers of a layer stack utilizing two RF generators that are capable of supplying three separate frequencies, in accordance with one embodiment of the present invention.

FIG. 5 illustrates one example method 500 operation utilized to deliver simultaneous frequencies from two separate generators, where 1 generator can deliver multiple mutually exclusive frequencies during deposition operations defined by a recipe. In this example, the recipe calls for delivering to simultaneous frequencies to an electrode of a process chamber so that a layered stack of material can be deposited over a surface of a semiconductor wafer. In operation 502, a substrate is provided into the processing chamber. In one embodiment, the processing chamber is a PECVD chamber. In one embodiment, the chamber is a single chamber system. In another embodiment, the chamber is part of a multiple chamber system (e.g. two chambers, four chambers, etc.).

In operation 504, once the wafer is sitting on a pedestal or chuck or substrate support in the chamber, process gasses A are delivered to the chamber. The process gasses A are selected so that the desired material will be deposited when RF power is provided to the chamber. In operation 506 and 508, RF power is provided using two separate simultaneous frequencies. Operation 506 includes applying a first frequency to the chamber electrode from a first generator and operation 508 applies a third frequency from a second RF generator. The third frequency in this example is simply the second frequency of a two simultaneous frequency application that is being performed in operations 506 and 508. In operation 510, a first material layer is deposited on the substrate or on another layer that has been previously performed on the substrate. Once the deposition process is complete and gases A have been evacuated or pumped out of the chamber or the wafer is moved into another chamber, the method moves operation 512. In operation 512, gases B are delivered to the process chamber (or another chamber if the wafer was moved to another chamber).

In operations 514 and 516, a second RF frequency is applied to the chamber electrode from the first generator and the third frequency is applied to the chamber electrode via the second generator. At this point, the first generator is now being used to deliver a different frequency than that provided when process gases A were used to deposit the first material layer. In operation 518, the second material layer is deposited over the first material layer. In another embodiment, the second material layer may be deposited over a different wafer if the second frequency and the third frequency were provided to another chamber having another wafer or if the wafer was changed in between the process operations.

Broadly speaking, one aspect of the method operation is that the first generator is capable of delivering two separate independent frequencies and efficiencies are provided by only requiring two RF generators when three different RF frequencies are needed to perform an alternating multimode multilayer deposition process over a semiconductor substrate or over a layer. In operation 520, it is determined if another layer should be deposited. If another layer should be deposited, the method moves back to operation 504 where the process can repeat any number of times as specified by a recipe.

Still referring to FIG. 5, the third frequency (f3) is from Generator B from FIG. 4. One example method is to deposit two layers in a repeat manner, e.g., L1, L2, L1, L2, L1, L2 . . . . For instance, L1 is deposited using f1 (from Generator A) and f3 (from Generator B), then L2 is deposited using f2 (from Generator A) and f3 (from Generator B), then L1 is deposited using f1 (from Generator A) and f3 (from Generator B), then L2 is deposited using f2 (from Generator A) and f3 (from Generator B), then L1 is deposited using f1 (from Generator A) and f3 (from Generator B), then L2 is deposited using f2 (from Generator A) and f3 (from Generator B). This process may be repeated any number of times depending on the recipe or desired layer stack. In some cases, the process is not repeated and only one layer is formed, e.g., only L1 or only L2. In this example, Generator A has two mutually exclusive oscillators (f1 and f2) and Generator B has one generator (f3). Again, in this example, Generator A has two mutually exclusive oscillators (f1 and f2), but the example of depositing two layers L1/L2/L1/L2 . . . will use f3 of the Generator B.

In an alternate embodiment, the generator 210A of FIG. 2A may be modified so that a signal is shared between the frequency oscillators 202*a* and 202*b*, so as to communicate a phase shift between the oscillators, and the switches 202*a* and 202*b* allow both frequencies to pass to the amplifier 206. In such a configuration, a combiner circuit would receive the output of switches 204*a* and 204*b* before being supplied to the amplifier 206. In this alternate embodiment, the higher frequency is an even multiple of a lower frequency, and both frequencies are simultaneously employed with an intentional phase shift between them. Having both frequency generators in the same single generator provides for an efficient manner of communicating the phase shift signal between the two frequency generators.

In still another alternate embodiment, a single generator includes two oscillators 202*a/b*, and each has their own independent voltage scaling electronic circuitry (e.g., separate amplifier logic) that are simultaneous with their outputs summed together and with a recipe selectable, nonzero phase shift between them.

Figure 6:
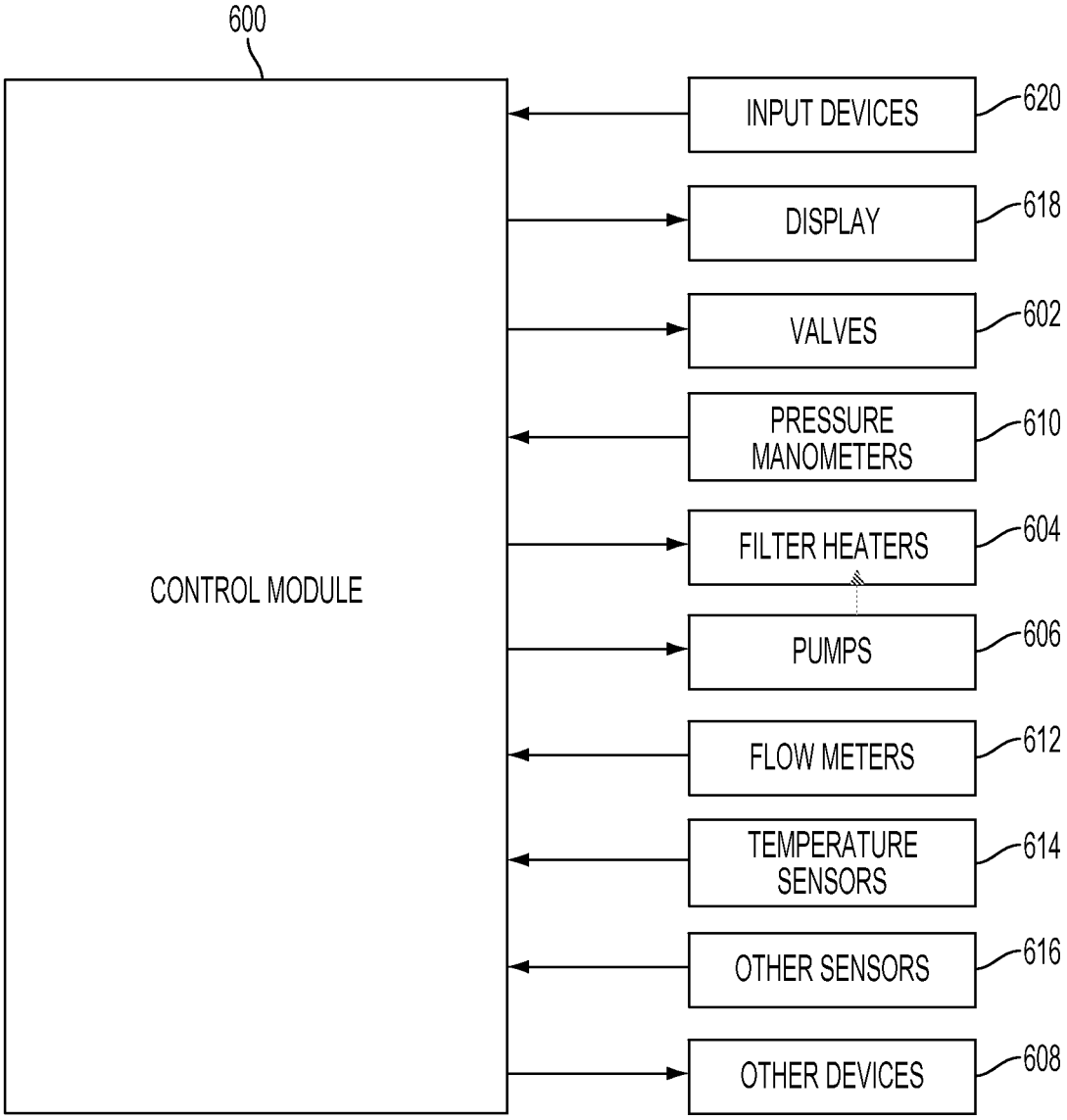
FIG. 6 shows a control module for controlling the systems, in accordance with one embodiment.

FIG. 6 shows a control module 600 for controlling the systems described above. In one embodiment, the control module 110 of FIG. 1 may include some of the example components. For instance, the control module 600 may include a processor, memory and one or more interfaces. The control module 600 may be employed to control devices in the system based in part on sensed values. For example only, the control module 600 may control one or more of valves 602, filter heaters 604, pumps 606, and other devices 608 based on the sensed values and other control parameters. The control module 600 receives the sensed values from, for example only, pressure manometers 610, flow meters 612, temperature sensors 614, and/or other sensors 616. The control module 600 may also be employed to control process conditions during precursor delivery and deposition of the film. The control module 600 will typically include one or more memory devices and one or more processors.

The control module 600 may control activities of the precursor delivery system and deposition apparatus. The control module 600 executes computer programs including sets of instructions for controlling process timing, delivery system temperature, pressure differentials across the filters, valve positions, mixture of gases, chamber pressure, chamber temperature, wafer temperature, RF power levels, wafer chuck or pedestal position, and other parameters of a particular process. The control module 600 may also monitor the pressure differential and automatically switch vapor precursor delivery from one or more paths to one or more other paths. Other computer programs stored on memory devices associated with the control module 600 may be employed in some embodiments.

Typically there will be a user interface associated with the control module 600. The user interface may include a display 618 (e.g. a display screen and/or graphical software displays of the apparatus and/or process conditions), and user input devices 620 such as pointing devices, keyboards, touch screens, microphones, etc.

Computer programs for controlling delivery of precursor, deposition and other processes in a process sequence can be written in any conventional computer readable programming language: for example, assembly language, C, C++, Pascal, Fortran or others. Compiled object code or script is executed by the processor to perform the tasks identified in the program.

The control module parameters relate to process conditions such as, for example, filter pressure differentials, process gas composition and flow rates, temperature, pressure, plasma conditions such as RF power levels and the low frequency RF frequency, cooling gas pressure, and chamber wall temperature.

The system software may be designed or configured in many different ways. For example, various chamber component subroutines or control objects may be written to control operation of the chamber components necessary to carry out the inventive deposition processes. Examples of programs or sections of programs for this purpose include substrate positioning code, process gas control code, pressure control code, heater control code, and plasma control code.

A substrate positioning program may include program code for controlling chamber components that are used to load the substrate onto a pedestal or chuck and to control the spacing between the substrate and other parts of the chamber such as a gas inlet and/or target. A process gas control program may include code for controlling gas composition and flow rates and optionally for flowing gas into the chamber prior to deposition in order to stabilize the pressure in the chamber. A filter monitoring program includes code comparing the measured differential(s) to predetermined value(s) and/or code for switching paths. A pressure control program may include code for controlling the pressure in the chamber by regulating, e.g., a throttle valve in the exhaust system of the chamber. A heater control program may include code for controlling the current to heating units for heating components in the precursor delivery system, the substrate and/or other portions of the system. Alternatively, the heater control program may control delivery of a heat transfer gas such as helium to the wafer chuck.

Examples of sensors that may be monitored during deposition include, but are not limited to, mass flow control modules, pressure sensors such as the pressure manometers 610, and thermocouples located in delivery system, the pedestal or chuck (e.g. the temperature sensors 614). Appropriately programmed feedback and control algorithms may be used with data from these sensors to maintain desired process conditions. The foregoing describes implementation of embodiments of the invention in a single or multi-chamber semiconductor processing tool.

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Although the foregoing embodiments have been described in some detail for purposes of clarity of understanding, it will be apparent that certain changes and modifications can be practiced within the scope of the appended claims. Accordingly, the present embodiments are to be considered as illustrative and not restrictive, and the embodiments are not to be limited to the details given herein, but may be modified within their scope and equivalents of the claims.

What is claimed is:

1. A radio frequency (RF) power supply, comprising, a first frequency oscillator for generating a first frequency signal;

a second frequency oscillator for generating a second frequency signal;

an amplifier;

a first switch connected to an output of the first frequency oscillator;

a second switch connected to an output of the second frequency oscillator, wherein an output of the first switch and the second switch connect to an input of the amplifier; and a switch control coupled to the first switch and the second switch, the switch control is configured to enable a connection via the first and second switches from only one of the first frequency oscillator or the second frequency oscillator to the amplifier at one time, wherein the amplifier configured to power amplify both of the first and second frequency signals from the first and second frequency oscillators.

2. The RF power supply of claim 1, further comprising, a frequency control coupled to each of the first frequency oscillator and the second frequency oscillator, the frequency control is configured to tune a frequency setting of the first and second frequency oscillators to compensate for signal match when an output of the amplifier is communicated to a transmission line that couples to an electrode of a chamber.

3. The RF power supply of claim 1, wherein the amplifier is coupled to a match network and the match network is coupled to a process chamber via a transmission line, the transmission line is connected to an electrode of the process chamber, wherein the amplified ones of the first and second frequency signals from the first and second frequency oscillators are provided to the electrode of the process chamber to enable generation of a plasma from process gases introduced into the plasma chamber, the plasma generated from the process gases used to deposit a material layer over a surface of a wafer when present on a support of the plasma chamber.

4. The RF power supply of claim 3, wherein a control module is coupled to the switch control to enable selection of the first or second frequency oscillators in accordance with a sequence defined by a deposition recipe.

5. The RF power supply of claim 1, wherein the switch control closes the first switch only when the second switch is open and closes the second switch only when the first switch is open, wherein a switch being closed enables the connection between one of the first or second frequency oscillators to the amplifier.

6. A system for processing a semiconductor wafer, comprising, a processing chamber, the processing chamber including a pedestal for supporting the semiconductor wafer when present, an electrode and a showerhead for delivering process gases into the chamber when processing a deposition layer over a surface of the semiconductor wafer;

a transmission line connected to the electrode of the processing chamber at a first end of the transmission line;

a match network connected to a second end of the transmission line;

a radio frequency (RF) power supply, including, a first frequency oscillator for generating a first frequency signal;

a second frequency oscillator for generating a second frequency signal;

an amplifier;

a first switch connected to an output of the first frequency oscillator;

a second switch connected to an output of the second frequency oscillator, wherein an output of the first switch and the second switch connect to an input of the amplifier and an output of the amplifier is connected to the match network; and a switch control coupled to the first switch and the second switch, the switch control is configured to enable a connection via the first and second switches from only one of the first frequency oscillator or the second frequency oscillator to the amplifier at one time, wherein the amplifier configured to power amplify both of the first and second frequency signals from the first and second frequency oscillators;

wherein the amplified ones of the first and second frequency signals are provided delivered to the electrode processing chamber via the match network and the transmission line.

7. The system of claim 1, further comprising, a frequency control coupled to each of the first frequency oscillator and the second frequency oscillator, the frequency control is configured to tune a frequency setting of the first and second frequency oscillators to compensate for signal match in addition to a match provided by the match network.

8. The system of claim 6, wherein a control module is coupled to the switch control to enable selection of the first or second frequency oscillators in accordance with a sequence defined by a deposition recipe.

9. The system of claim 1, wherein the switch control closes the first switch only when the second switch is open and closes the second switch only when the first switch is open, wherein a switch being closed enables the connection between one of the first or second frequency oscillators to the amplifier.

10. The system of claim 1, wherein the RF power supply is integrated as a single generator unit.

11. A system for processing a semiconductor wafer, comprising, a processing chamber, the processing chamber including a pedestal for supporting the semiconductor wafer when present, an electrode and a showerhead for delivering process gases into the chamber when processing a deposition layer over a surface of the semiconductor wafer;

a first RF power supply having a single frequency oscillator for generating a single frequency signal, the first RF power supply including a first amplifier having an output that is connected to the electrode of the processing chamber via a first transmission line, wherein the first amplifier is for amplifying the single frequency signal of the single frequency oscillator;

a second RF power supply having a first frequency oscillator for generating a first frequency signal and a second frequency oscillator for generating a second frequency signal, the second RF power supply including a second amplifier, the second RF power supply includes a first switch connected to an output of the first frequency oscillator and a second switch connected to an output of the second frequency oscillator, wherein an output of the first switch and the second switch connect to an input of the second amplifier and an output of the second amplifier having an output that is connected to the electrode of the processing chamber via a second transmission line, and wherein the second RF power supply includes a switch control coupled to the first switch and the second switch, the switch control is configured to enable a connection via the first and second switches from only one of the first frequency oscillator or the second frequency oscillator to the second amplifier at one time, wherein the second amplifier is for amplifying both of the first and second frequency signals from the first and second frequency oscillators;

a controller for setting a recipe that defines a sequence of multi-frequency application from the first and second RF power supplies to the electrode of the processing chamber, wherein the recipe defines a first mode that applies the single frequency signal from the first RF power supply together with the first frequency signal from the second RF power supply, and a second mode that applies the single frequency signal from the first RF power supply together with the second frequency signal from the second frequency signal, wherein the controller enables the first and second mode to deposit a first layer material and the second mode to deposit a second layer material over the first layer material, the recipe defines a number of times the first and second modes repeat;

wherein only the first and second RF power supplies are included in the system to enable the three frequency signals that include the first frequency signal, the second frequency signal and the single frequency signal.

12. The system of claim 11, wherein a first match network connected to the first transmission line and a second match network is connected to the second transmission line.

13. The system of claim 11, further comprising, a frequency control coupled to each of the first frequency oscillator and the second frequency oscillator of the second RF power supply, the frequency control is configured to tune a frequency setting of the first and second frequency oscillators to compensate for signal match when an output of the second amplifier is communicated to the second transmission line.

14. The system of claim 11, wherein the first frequency signal is about 13.56 MHz and the second frequency signal is about 27 MHz and the single frequency signal is about 400 KHz, wherein, the first mode applies 13.56 MHz and 400 KHz together to the electrode, and the second mode applies 27 MHz and 400 KHz together to the electrode.

15. The system of claim 11, wherein a control module is coupled to the switch control to enable selection of the first or second frequency oscillators in accordance with a sequence defined by the recipe.

16. The system of claim 11, wherein the switch control closes the first switch only when the second switch is open and closes the second switch only when the first switch is open, wherein a switch being closed enables the connection between one of the first or second frequency oscillators to the second amplifier.

* * * * *